US006751849B1

(12) United States Patent
Helmke et al.

(10) Patent No.: US 6,751,849 B1
(45) Date of Patent: Jun. 22, 2004

(54) METHOD FOR CONNECTING A CONTACT BODY AND A FLEXIBLE CONDUCTOR, AND A COMPRESSION MOLD FOR CARRYING OUT SAID METHOD

(75) Inventors: Ulrich Helmke, Berlin (DE); Harald Kurzmann, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/889,787

(22) PCT Filed: Jan. 19, 2000

(86) PCT No.: PCT/DE00/00182

§ 371 (c)(1),
(2), (4) Date: Jul. 20, 2001

(87) PCT Pub. No.: WO00/44013

PCT Pub. Date: Jul. 27, 2000

(30) Foreign Application Priority Data

Jan. 20, 1999 (DE) ..... 199 02 836

(51) Int. Cl.[7] ..... H01H 65/00

(52) U.S. Cl. ..... 29/622; 335/106; 335/192; 29/838; 29/844

(58) Field of Search ..... 29/622, 838, 844, 29/876, 882; 335/106, 16, 195, 192; 219/117.1; 200/211, 511

(56) References Cited

U.S. PATENT DOCUMENTS 4,067,102 A * 1/1978 DuRocher et al. ..... 264/104
4,224,496 A * 9/1980 Riordan et al. ..... 219/110
4,583,065 A * 4/1986 Favre-Tissot ..... 335/106

FOREIGN PATENT DOCUMENTS

| | | | |
|---|---|---|---|
| DE | A14416104 | | 10/1995 |
| EP | A467798 | | 1/1992 |
| EP | 1756752 | | 5/1997 |
| FR | A1279798 | | 5/1962 |
| FR | 1279798 | * | 5/1962 |
| FR | 467798 | * | 1/1992 |
| GB | A985597 | | 3/1965 |

* cited by examiner

*Primary Examiner*—I Cuda Rosenbaum
*Assistant Examiner*—Stephen Kenny
(74) *Attorney, Agent, or Firm*—Harness, Dickey & Pierce, P.L.C.

(57) ABSTRACT

A movable contact arrangement suitable for use in a switching device has a rigid contact body and a flexible conductor piece connecting the contact body to a fixed conductor. The contact body is connected to the conductor piece by mechanically compressing a section of a semifinished product in the form of a cable or strand, with the flexible conductor piece being formed by an uncompressed part of the semifinished product. The compressing operation can also be used at the same time to produce the contact body from the semifinished product. The method described allows low-cost production of contact modules for power circuit breakers used in sophisticated mechanical and electrical equipment.

12 Claims, 2 Drawing Sheets

METHOD FOR CONNECTING A CONTACT BODY AND A FLEXIBLE CONDUCTOR, AND A COMPRESSION MOLD FOR CARRYING OUT SAID METHOD

This application is the national phase under 35 U.S.C. § 371 of PCT International Application No. PCT/DE00/00182 which has an International filing date of Jan. 9, 2000, which designated the United States of America and which is hereby incorporated herein by reference.

FIELD OF THE INVENTION

The invention relates to a method for producing a module of a current path of a switching device, the module comprising a rigid contact body and a flexible conductor piece including component conductors.

Modules of this type are a component part of much electrical switchgear, in particular that in which the rigid contact body is movably arranged and can be actuated by a drive mechanism for switching the switching device on and off. For this purpose, the rigid contact body, provided with a contact facing, interacts with a relatively fixed mating contact. A relatively fixed arrangement is understood in the present context as meaning that a component referred to in this way is a component part of a switching device which includes the movable contact arrangement.

BACKGROUND OF THE INVENTION

The previously known methods of the type stated at the beginning are based on the idea that a rigid contact body produced from a solid material is provided, for example by punching out from copper sheet, and that a section of the semifinished product in the form of a cable or strand is securely connected to this contact body by welding or soldering. Since the quality of the connection between the flexible conductor piece and the rigid contact body is decisive for the switchgear to have an adequate service life, only methods which provide a not only mechanically durable but also equally electrically high-grade connection come into consideration for the connection of the parts. A contact arrangement and a method for connecting a contact body to a flexible conductor are described for example in EP 0 467 798 A1 or DE 44 16 104 A1.

The switchgear considered here includes multipole low-voltage power circuit breakers with a nominal current of up to several 1000 A, which have a plurality or a multiplicity of contact bodies for each pole. In the case of such power circuit breakers, the costs for the connection of the contact bodies to the flexible conductors represent a not inconsiderable part of the overall production costs.

FR 1 279 798 A discloses a method which serves for connecting a wire to a rigid conductor. According to this method, a part-length of the wire is compressed into a dovetail-shaped groove of a connection piece or some other conductor piece by applying a pressure. In this case, the cross section of the wire is chosen such that it is only partly accommodated in the groove and a remaining residual volume forms a cross-sectionally mushroom-like or web-like protrusion. In the compressing operation, the wire becomes plastic, whereas the connection piece or conductor piece with the groove is deformed only elastically. Therefore, an unreleasable connection, required for the purposes of the invention, between the two conductors to be connected is not obtained.

SUMMARY OF THE INVENTION

On the basis of a method of the type explained at the beginning, the invention is based on the object of permitting inexpensive production of modules of the type mentioned with good quality.

This object is achieved according to the invention by a part-length of a section of a semifinished product, forming the flexible conductor piece, being subjected to mechanical compression by means of a pressing force up to the flow limit and the rigid contact body being completely or partially formed as a result, while the flexible conductor piece is formed by a second part-length of the section of said semifinished product, not subjected to the compression.

In the method according to the invention, neither is a solder material supplied nor is a high temperature used. Consequently, the difficulties frequently occurring previously, such as rupture of the flexible conductor piece at the point of connection with the rigid contact body or an increased transition resistance, are avoided in principle.

Within the scope of the invention, a first part-length of a section of a semifinished product used for producing the flexible conductor piece may be brought into contact with a bearing face, intended for the connection, of a separately provided contact body and said part-length may be mechanically compressed by a pressing force acting against the bearing face to produce a laminar connection.

According to another embodiment of the invention, the rigid contact body may be produced by mechanical compression of a first part-length of a section of a semifinished product used for producing the flexible conductor piece, while the flexible conductor piece is formed by a second part-length of the section of said semifinished product which is not subjected to the compression. The advantage of this method is that only the semifinished product which is used for the production of the flexible conductor pieces is required for producing the module comprising the contact body and flexible conductor.

A further advantageous refinement of the above methods allows the integration of the modules considered here into a switching device to be made easier. For this purpose, mechanical compression of a third part-length of the section of the semifinished product is used for forming a connection piece serving for connection to a relatively fixed conductor of the switching device.

If the semifinished product used within the scope of the invention, for example fine-wired copper strand, is of a clean and uniform quality customary for electrotechnical purposes, it will be possible when an appropriate pressure is applied to produce compressed articles with a density which is not inferior to customary solid material. However, it is not possible to rule out the possibility of the semifinished product used being locally soiled and or partially oxidized during storage or already during production. If such a material is processed as part of an automated production process, parts deviating from the prescribed quality standard may be formed, without this being externally evident. The cause may be, for example, inclusions and inadequate binding. According to one refinement of the methods described, quality deviations of the type described can be avoided by the mechanical compression being carried out in the presence of a flux. A further advantage which is achieved is that a lower pressure is adequate and, as a result, the material and compression mold undergo less severe loading.

If use is made of the possibility of producing the module by using an existing contact body, this can preferably take place by using a compression mold which has a chamber for receiving an end part of the contact body and the first part-length of the semifinished product and also has an entry opening for the part-length of the semifinished product, the pressing force being exerted by means of an associated press die.

If, on the other hand, it is envisaged to produce the contact body in the way mentioned completely from the semifinished product for flexible conductor pieces, the method can advantageously take place by using a compression mold with a chamber which corresponds to the contact body and has an entry opening for the first part-length of the section of the semifinished product. The pressing force is likewise exerted by means of an associated press die.

Both aforementioned types of method can also be used for producing a contact arrangement with two or more flexible conductor pieces for each contact body. For this purpose, a compression mold with an entry opening dimensioned to correspond to the complete cross section of the conductor pieces can be used.

It has already been mentioned that the rigid contact bodies are provided with a contact facing dimensioned in a way corresponding to the respectively given switching task. According to a further refinement of the method described, such a contact facing may be embedded at least partly into the semifinished product during the compression of the semifinished product. To facilitate this embedding, the contact facing may be provided with at least one continuation intended for the embedding into the semifinished product.

The invention is explained in more detail below on the basis of the exemplary embodiments represented in the figures.

Figure 2:
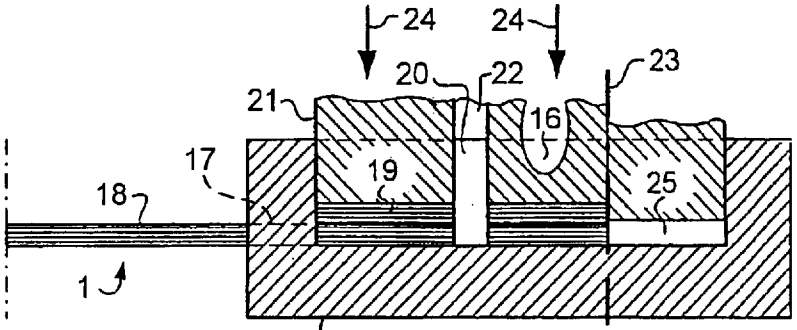

Illustrated in FIG. 2, on the basis of another compression mold, is a method in which rigid contact bodies are produced with an attached flexible conductor of a semifinished product used for flexible conductor pieces.

Figure 3:
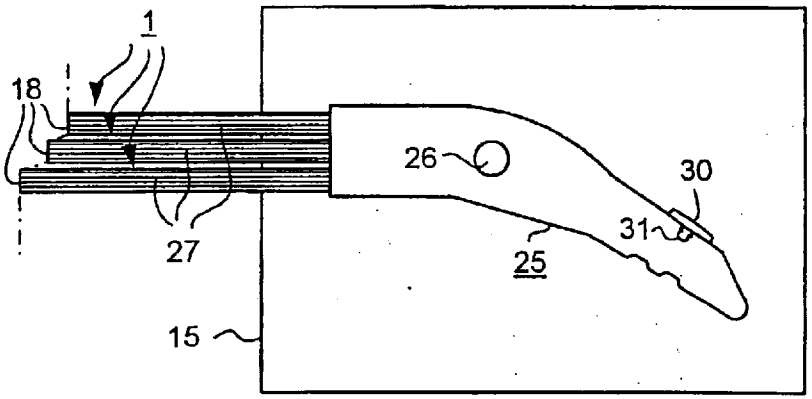

FIG. 3 shows the compression mold according to FIG. 2 in plan view after completion of the contact body and after removal of the press die.

Figure 4:
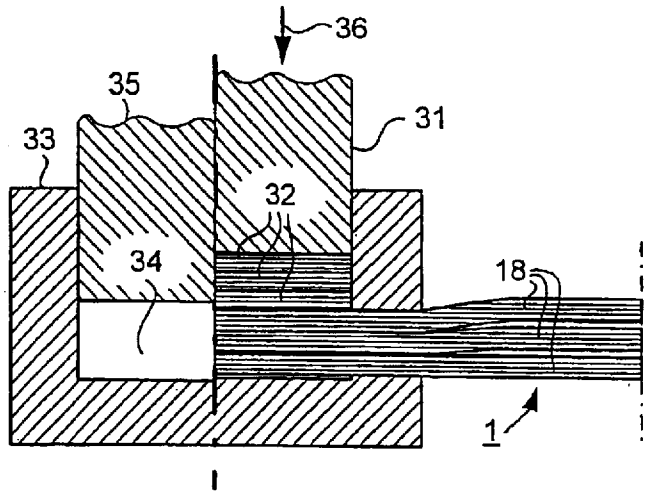

In FIG. 4, the forming of end parts of flexible conductors into a solid connection piece by means of another compression mold is illustrated.

Figure 5:
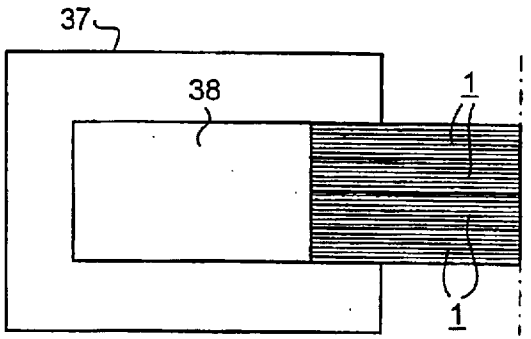

FIG. 5 shows the compression mold corresponding to FIG. 4 in plan view, it being assumed that the flexible conductors of a plurality of parallel contact bodies are formed into a common connection piece.

DETAILED DESCRIPTION OF THE DRAWINGS

Figure 1:
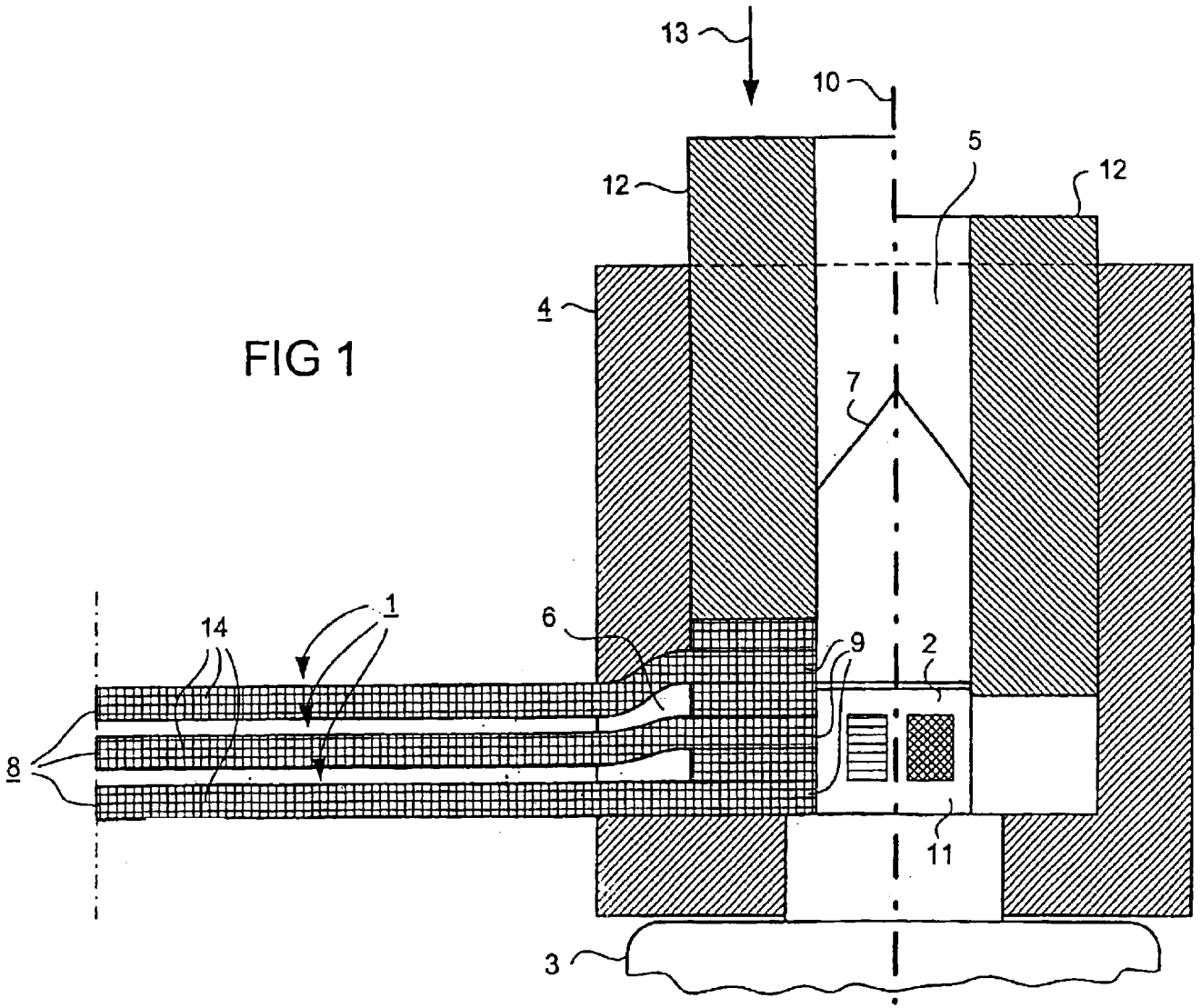
FIG. 1 illustrates a compression mold for a process for producing a module of the current path of a switching device using a separately provided contact body.

The method illustrated in FIG. 1 serves for attaching flexible conductor pieces 1 to a rigid contact body 2 of copper, which in the example shown forms the movable contact stud of a vacuum switching tube 3. The method is carried out by means of a compression mold 4 which includes a central filling pin 7, which adjoins the contact body 2 and continues the profile of the latter.

In the example according to FIG. 1, three flexible conductor pieces 1 are provided, the entry opening 6 of the compression mold 4 being adapted to their complete cross section. In a known way, more or fewer conductor pieces 1 may be provided according to the cross section of the contact body 2 and the semifinished product. The flexible conductor pieces 1 are preferably produced from a semifinished product of copper in the form of a strand or cable, from which firstly sections 8 of a suitable length are cut off. First part-lengths 9 of the sections 8 are introduced through the mentioned entry opening 6 into the chamber 5 of the compression mold 4. With regard to the intended mechanical compression, the part-lengths 9 are dimensioned such that they can be placed in two layers around the contact body 2. Since, in the present example, three flexible conductor pieces 1 are regarded as adequate for the carrying of the current to the contact body 2, in the chamber 5 of the compression mold 4 there are initially six layers of the semifinished product, as represented in FIG. 1 on the left of a dash-dotted line 10. The part-lengths 9 of the mentioned semifinished product are then in contact with a cylindrical bearing face 11 at the periphery of the contact body 2, which may be roughened or profiled in a suitable way, as indicated in FIG. 1 by a cross-knurled face or a face provided with parallel grooves.

A tubular press die 12 is then inserted into the compression mold 4 and subjected to a pressing force in the direction of an arrow 13. The pressing force is chosen such that the material of the semifinished product in the form of a cable or strand is stressed to the flow limit and, as a result, comes into intimate contact with the bearing face 11 of the contact body 12. The high pressing force produces a laminar connection between the material of the semifinished product of the part-lengths 9 and the contact body 2. During the compressing operation, the material of the part-lengths 9 is compressed to the extent shown on the right of the dash-dotted line 10. The layers of part-lengths 9, of which there are six in all, then take up a slightly smaller height than the height of the contact body 2. Once the vacuum switching tube 3 has been separated from the compression mold 4, which can be made easier by a parting of the compression mold, a second part-length 14 of the sections 8 forms the flexible conductor pieces 1.

The method illustrated in FIG. 1 can be used in the same way analogously for differently designed contact bodies as well. In particular, rigid contact bodies in the form of contact levers for air-switching low-voltage power circuit breakers can also be provided with flexible conductor pieces by this method. With regard to the fact that the contact levers are of a relatively small height, it is however recommendable in this case to arrange the part-lengths of the semifinished product in the plane of the contact lever if more than one flexible conductor piece is provided for each contact lever.

In the case of the method illustrated in FIGS. 2 and 3, the required module is produced from flexible conductor pieces 1 and a rigid contact body by both parts being produced together. For this purpose, a compression mold 15 with a chamber 16 and an entry opening 17 leading into the chamber is provided. A part-length 19 of a section 18 of a semifinished product of the type described, which is dimensioned in such a way that its mass corresponds to the contact body to be produced, is introduced into the chamber 16. Since the contact body is to be given a through-opening suitable for pivotable mounting, the compression mold is provided with a pin 20. A press die 21 has a clearance 22 corresponding to the pin 20.

FIG. 2 is divided by a dash-dotted line 23 into a left-hand part and a right-hand part, the left-hand part showing the state before a pressing force acts in a way corresponding to an arrow 24 and the right-hand part showing the state after completion of the compressing operation. FIG. 3 follows on from the state according to the right-hand part of FIG. 2 and shows the compression mold 15 in plan view with the press die 21 removed and a completed contact body 25. This is designed as the contact lever of an air-switching low-voltage power circuit breaker and has a mounting opening 26 produced by means of the pin 22 (FIG. 2). As a result of the pressure up to the flow limit of the material of the semifinished product, the contact body 25 is of a uniform solid consistency, such as that of a contact body punched for example from material in sheet form.

Remaining second part-lengths 27 of the section 18 form the flexible conductor pieces 1, by which the contact body 25 pivotably mounted in a switching device can be connected to a fixed conductor. The one-piece production of the contact body 25 and the flexible conductor pieces 1 without the use of heat has the effect that the flexibility of the semifinished product used is fully retained.

The compressing operation explained with reference to FIG. 2 is used at the same time to connect a contact facing 30 to the contact body 25. For this purpose, the contact facing 30 has on its rear side a profiled continuation 31 for anchorage in the material of the semifinished product of the part-lengths 19.

To facilitate the connection of the flexible conductor pieces to a fixed conductor, the sections 18 of the semifinished product may be dimensioned in such a way as to leave a third part-length 32, which is formed in a further compression mold 33 according to FIG. 4 into a connection piece 34. For this purpose, a press die 35 is subjected in the way already described to a pressing force in the direction of an arrow 36. It is recommendable to ensure by a double-layered arrangement of the part-lengths in the compression mold that the thickness of the connection piece 34 corresponds approximately to the thickness of the uncompressed conductor pieces 1.

As already mentioned, there may be a plurality of identical contact bodies wit attached flexible conductor pieces in each pole of a multipole switching device. It may help to facilitate the production of the switching devices if the flexible conductors of the contact bodies belonging together are joined together by means of a correspondingly dimensioned compression mold 37 to form a single connection piece 38, as is shown in FIG. 5.

It was mentioned at the beginning that, when semifinished products of a quality customary for electrotechnical purposes are used, good working results are generally achieved without any problem. However, unavoidable quality deviations of the semifinished product can be overcome and/or a lower pressure can be applied if the mechanical compression of the semifinished product in the compression mold is carried out in the presence of a flux. For the present purpose, the fluxes known for the soldering or brazing of copper are suitable in particular. Such fluxes have the property of dissolving oxide films, allowing the metal parts that are to be connected to enter into intimate contact. For use within the scope of the invention, the semifinished product to be processed may already be treated with the flux concerned before it is introduced into the compression mold. A lower consumption of flux can be achieved, however, by a suitably chosen dose of the flux being introduced together with the semifinished product to be compressed into the respectively used compression mold 4, 15, 33 or 37.

During compressing, the flux initially penetrates through all the voids between the fine wires of the semifinished product and, as the pressure increases, is brought intensively into contact with the material of the semifinished product. Once the transformation into a solid body has been completed, excess flux is expelled and can therefore be removed, for example in a water bath.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing a module of a current path of a switching device, the module including a rigid contact body and a flexible conductor piece including component conductors, the method comprising:

subjecting a first part-length of a section of a semifinished product, the semifinished product having a form of one of a litz wire and a stranded conductor including component conductors, to mechanical compression by means of a pressing force up to a flow limit, the mechanical compression transforming the component conductors to a solid body;

forming the flexible conductor piece by a second part-length of the section of said semifinished product, not subjected to the compression; and bringing the first part-length into contact with a bearing face of an end part of the rigid contact body by way of the pressing force, and wherein the pressing force creates a laminar connection between the solid body and the end part of the rigid contact body.

2. The method as claimed in claim 1, wherein mechanical compression of a third part-length of the section of the semifinished product is used for forming a connection piece serving for connection to a relatively fixed conductor of the switching device.

3. The method as claimed in claim 2, wherein the mechanical compression of the semifinished product is carried out in the presence of a flux.

4. The method as claimed in claim 1, wherein the mechanical compression of the semifinished product is carried out in the presence of a flux.

5. The method as claimed in claim 1, wherein a compression mold with a chamber is used for receiving an end part of the contact body and the first part-length of the semifinished product, and wherein the pressing force is exerted by means of an associated press die.

6. A compression mold used for the method as claimed in claim 5, wherein, for producing a contact arrangement with two or more flexible conductor pieces for each contact body, an entry opening dimensioned to correspond to the complete cross section of the conductor pieces is provided.

7. A method for producing a module of a current path of a switching device, the module including a rigid contact body and a flexible conductor piece including component conductors, the method comprising:

subjecting a first part-length of a section of a semifinished product, the semifinished product having a form of one of a litz wire and a stranded conductor including component conductors, to mechanical compression by means of a pressing force up to a flow limit, the mechanical compression transforming the component conductors to the rigid contact body; and forming the flexible conductor piece by a second part-length of the section of said semifinished product, not subjected to the compression.

8. The method as claimed in claim 7, wherein a compression mold is used, with a chamber corresponding to the contact body and with an entry opening for the first part-length of the section of the semifinished product, and wherein the pressing force is exerted by means of an associated press die.

9. The method as claimed in claim 7, wherein a contact facing is embedded at least partly into the material of the semifinished product during the compression of the semifinished product by way of a compression mold and press die.

10. The method as claimed in claim 9, wherein a contact facing with at least one continuation, intended for the embedding into the semifinished product, is used.

11. The method as claimed in claim 7, wherein mechanical compression of a third part-length of the section of the semifinished product is used for forming a connection piece serving for connection to a relatively fixed conductor of the switching device.

12. The method as claimed in claim 7, wherein the mechanical compression of the semifinished product is carried out in the presence of a flux.

* * * * *